US010850511B2

(12) United States Patent
Govyadinov et al.

(10) Patent No.: US 10,850,511 B2
(45) Date of Patent: Dec. 1, 2020

(54) FLUID EJECTION DEVICE

(71) Applicant: HEWLETT-PACKARD DEVELOPMENT COMPANY, L.P., Houston, TX (US)

(72) Inventors: Alexander Govyadinov, Corvallis, OR (US); Tsuyoshi Yamashita, Corvallis, OR (US); Erik D. Torniainen, Corvallis, OR (US); Nicholas McGuinness, San Diego, CA (US); David P. Markel, Corvallis, OR (US)

( * ) Notice: Subject to any disclaimer, the term of this patent is extended or adjusted under 35 U.S.C. 154(b) by 0 days.

(21) Appl. No.: 16/402,969

(22) Filed: May 3, 2019

(65) Prior Publication Data

US 2019/0255845 A1 Aug. 22, 2019

Related U.S. Application Data

(63) Continuation of application No. 15/747,835, filed as application No. PCT/US2015/057639 on Oct. 27, 2015, now Pat. No. 10,308,020.

(51) Int. Cl.
*B41J 2/14* (2006.01)

(52) U.S. Cl.
CPC ..... *B41J 2/14016* (2013.01); *B41J 2/1404* (2013.01); *B41J 2/14056* (2013.01); *B41J 2002/14467* (2013.01); *B41J 2202/11* (2013.01); *B41J 2202/12* (2013.01)

(58) Field of Classification Search
CPC .. B41J 2/14016; B41J 2/14056; B41J 2/1404; B41J 2002/14467; B41J 2202/12; B41J 2202/11
See application file for complete search history.

(56) References Cited

U.S. PATENT DOCUMENTS

| | | | |
|---|---|---|---|
| 6,244,694 | B1 | 6/2001 | Weber et al. |
| 7,396,109 | B2 | 7/2008 | Courian |
| 8,807,719 | B2 | 8/2014 | Hoisington et al. |
| 8,814,293 | B2 | 8/2014 | Strunk et al. |
| 2012/0007921 | A1 | 1/2012 | Govyadinov et al. |
| 2012/0113197 | A1 | 5/2012 | Kashu et al. |
| 2013/0083136 | A1 | 4/2013 | Govyadinov et al. |
| 2013/0155135 | A1 | 6/2013 | Govyadinov et al. |

(Continued)

FOREIGN PATENT DOCUMENTS

| | | | |
|---|---|---|---|
| CN | 102985261 | A | 3/2013 |
| EP | 1525983 | B1 | 4/2005 |

(Continued)

OTHER PUBLICATIONS

IP.com search (Year: 2020).*

(Continued)

*Primary Examiner* — Lisa Solomon
(74) *Attorney, Agent, or Firm* — Rahman LLC

(57) ABSTRACT

A fluid ejection device includes a fluid slot, a first fluid ejection chamber communicated with the fluid slot and including a first drop ejecting element, a second fluid ejection chamber communicated with the fluid slot and including a second drop ejecting element, a fluid circulation path communicated with the first fluid ejection chamber and the second fluid ejection chamber, and a fluid circulating element within the fluid circulation path.

20 Claims, 9 Drawing Sheets

(56) References Cited

U.S. PATENT DOCUMENTS

| | | | | |
|---|---|---|---|---|
| 2013/0155152 | A1* | 6/2013 | Govyadinov | B41J 2/18 347/54 |
| 2015/0049141 | A1 | 2/2015 | Taff et al. | |
| 2015/0070446 | A1 | 3/2015 | Taff et al. | |
| 2015/0273853 | A1 | 10/2015 | Govyadinov et al. | |

FOREIGN PATENT DOCUMENTS

| | | | | |
|---|---|---|---|---|
| JP | 2003011965 | A | * | 1/2003 |
| WO | 2014003772 | A1 | | 1/2014 |

OTHER PUBLICATIONS

Govyadinov et al., WO2017074324, Written Opinion, dated Oct. 27, 2015, 9 pages.
Govyadinov et al., WO2017074324, International Search Report, dated Oct. 27, 2015, 4 pages.
Lynn, C., "Innovations in Inkjet Print Head Technology," SGIA Journal, pp. 23-27, Jan./Feb. 2014.

* cited by examiner

FLUID EJECTION DEVICE

CROSS-REFERENCE TO RELATED APPLICATIONS

This application is a continuation of U.S. application Ser. No. 15/747,835, filed on Jan. 26, 2018, which is a national stage application filed under 35 U.S.C. § 371 of PCT/US2015/057639, filed on Oct. 27, 2015, the complete disclosures of which, in their entireties, are herein incorporated by reference.

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
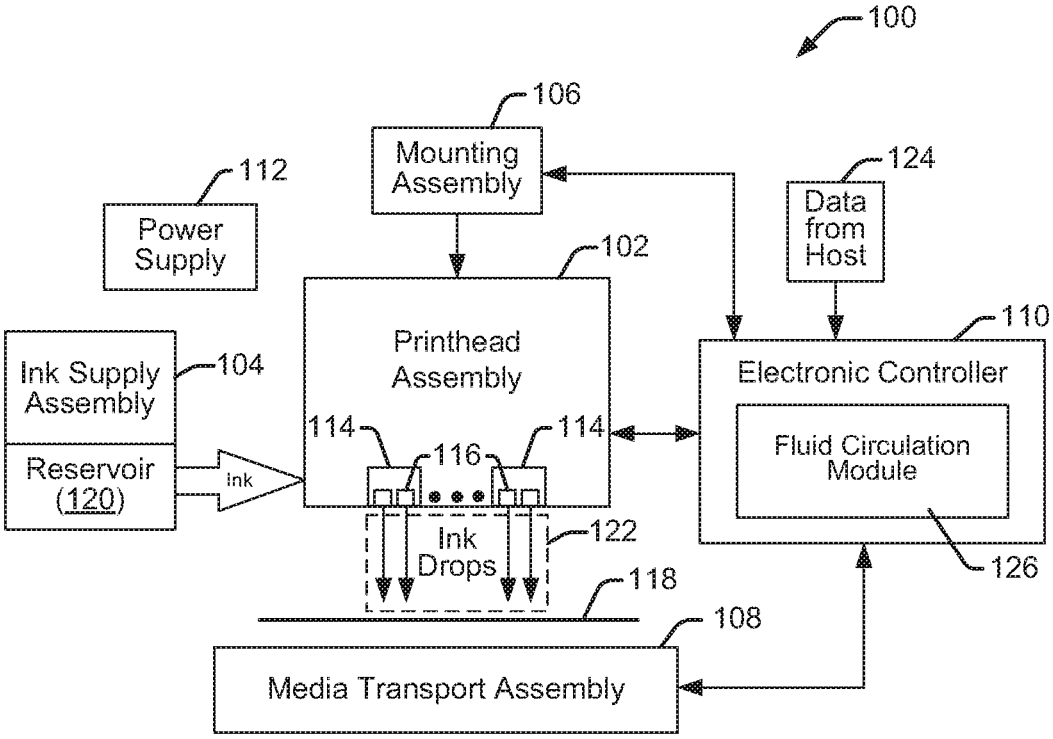
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2:
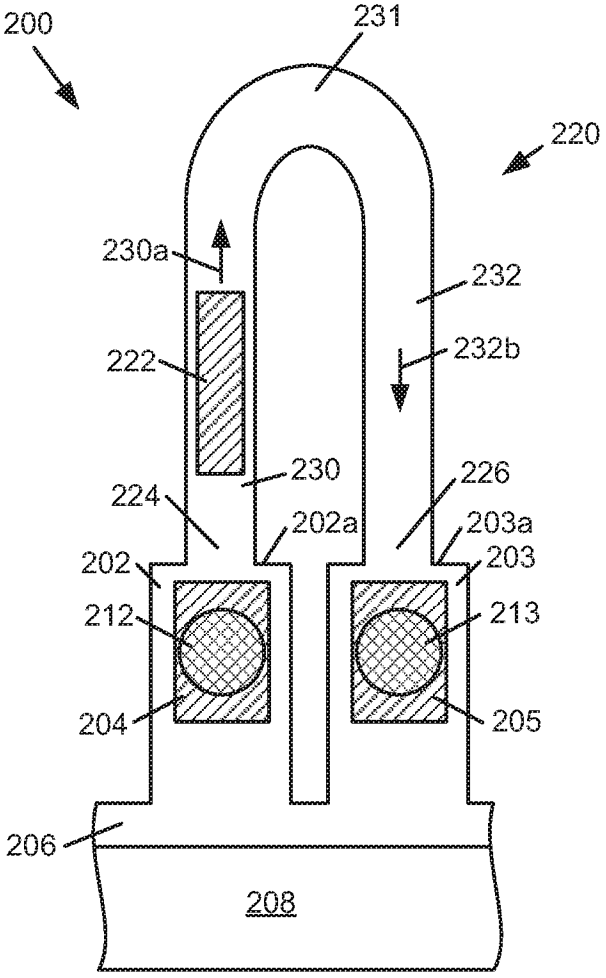
FIG. 2 is a schematic plan view illustrating an example of a portion of a fluid ejection device.

FIG. 2 is a schematic plan view illustrating an example of a portion of a fluid ejection device 200. Fluid ejection device 200 includes a first fluid ejection chamber 202 and a corresponding drop ejecting element 204 formed in, provided within, or communicated with fluid ejection chamber 202, and a second fluid ejection chamber 203 and a corresponding drop ejecting element 205 formed in, provided within, or communicated with fluid ejection chamber 203.

In one example, fluid ejection chambers 202 and 203 and drop ejecting elements 204 and 205 are formed on a substrate 206 which has a fluid (or ink) feed slot 208 formed therein such that fluid feed slot 208 provides a supply of fluid (or ink) to fluid ejection chambers 202 and 203 and drop ejecting elements 204 and 205. Fluid feed slot 208 includes, for example, a hole, passage, opening, convex geometry or other fluidic architecture formed in or through substrate 206 by which or through which fluid is supplied to fluid ejection chambers 202 and 203. Fluid feed slot 208 may include one (i.e., a single) or more than one (e.g., a series of) such hole, passage, opening, convex geometry or other fluidic architecture that communicates fluid with one (i.e., a single) or more than one fluid ejection chamber, and may be of circular, non-circular, or other shape. Substrate 206 may be formed, for example, of silicon, glass, or a stable polymer.

In one example, fluid ejection chambers 202 and 203 are formed in or defined by a barrier layer (not shown) provided on substrate 206, such that fluid ejection chambers 202 and 203 each provide a "well" in the barrier layer. The barrier layer may be formed, for example, of a photoimageable epoxy resin, such as SU8. In one example, a nozzle or orifice layer (not shown) is formed or extended over the barrier layer such that nozzle openings or orifices 212 and 213 formed in the orifice layer communicate with respective fluid ejection chambers 202 and 203.

In one example, as illustrated in FIG. 2, nozzle openings or orifices 212 and 213 are of the same size and shape. As such, nozzle openings or orifices 212 and 213 enable the ejection of drops of the same size (weight). Accordingly, drop ejecting elements 204 and 205 may be operated separately or individually at different moments of time to produce drops of the same size (weight), or operated simultaneously to produce a combined drop of a combined size (weight). Nozzle openings or orifices 212 and 213 may be of a circular, non-circular, or other shape. Although illustrated as being of the same size, nozzle openings or orifices 212 and 213 may be of different sizes (for example, different diameters, effective diameters, or maximum dimensions). Although illustrated as being of the same shape, nozzle openings or orifices 212 and 213 may be of different shapes (for example, one circular, one non-circular). In addition, although illustrated as being of the same shape and same size, drop ejecting elements 204 and 205 and corresponding fluid ejection chambers 202 and 203 may be of different shapes, and may be of different sizes.

Drop ejecting elements 204 and 205 can be any device capable of ejecting fluid drops through corresponding nozzle openings or orifices 212 and 213. Examples of drop ejecting elements 204 and 205 include thermal resistors or piezoelectric actuators. A thermal resistor, as an example of a drop ejecting element, may be formed on a surface of a substrate (substrate 206), and may include a thin-film stack including an oxide layer, a metal layer, and a passivation layer such that, when activated, heat from the thermal resistor vaporizes fluid in corresponding fluid ejection chamber 202 or 203, thereby causing a bubble that ejects a drop of fluid through corresponding nozzle opening or orifice 212 or 213. A piezoelectric actuator, as an example of a drop ejecting element, generally includes a piezoelectric material provided on a moveable membrane communicated with corresponding fluid ejection chamber 202 or 203 such that, when activated, the piezoelectric material causes deflection of the membrane relative to corresponding fluid ejection chamber 202 or 203, thereby generating a pressure pulse that ejects a drop of fluid through corresponding nozzle opening or orifice 212 or 213.

As illustrated in the example of FIG. 2, fluid ejection device 200 includes a fluid circulation path or channel 220 and a fluid circulating element 222 formed in, provided within, or communicated with fluid circulation channel 220. Fluid circulation channel 220 is open to and communicates at one end 224 with fluid ejection chamber 202 and is open to and communicates at another end 226 with fluid ejection chamber 203. In one example, end 224 of fluid circulation channel 220 communicates with fluid ejection chamber 202 at an end 202*a* of fluid ejection chamber 202, and end 226 of fluid circulation channel 220 communicates with fluid ejection chamber 203 at an end 203*a* of fluid ejection chamber 203.

In one example, fluid circulating element 222 is provided in, provided along, or communicated with fluid circulation channel 220 between end 224 and end 226. More specifically, in one example, fluid circulating element 222 is provided in, provided along, or communicated with fluid circulation channel 220 between fluid ejection chamber 202 and fluid ejection chamber 203. In one example, and as further described below, a position of fluid circulating element 222 may vary along fluid circulation channel 220.

Fluid circulating element 222 forms or represents an actuator to pump or circulate (or recirculate) fluid through fluid circulation channel 220. As such, fluid from fluid feed slot 208 circulates (or recirculates) through fluid circulation channel 220 and fluid ejection chambers 202 and 203 based on flow induced by fluid circulating element 222. In one example, circulating (or recirculating) fluid through fluid ejection chambers 202 and 203 helps to reduce ink blockage and/or clogging in fluid ejection device 200.

In the example illustrated in FIG. 2, drop ejecting elements 204 and 205 and fluid circulating element 222 are each thermal resistors. Each of the thermal resistors may include, for example, a single resistor, a split resistor, a comb resistor, or multiple resistors. A variety of other devices, however, can also be used to implement drop ejecting elements 204 and 205 and fluid circulating element 222 including, for example, a piezoelectric actuator, an electrostatic (MEMS) membrane, a mechanical/impact driven membrane, a voice coil, a magneto-strictive drive, and so on.

In one example, fluid circulation channel 220 includes a path or channel portion 230 communicated with fluid ejection chamber 202, and a path or channel portion 232 communicated with fluid ejection chamber 203. As such, in one example, fluid in fluid circulation channel 220 circulates (or recirculates) between fluid ejection chamber 202 and fluid ejection chamber 203 through channel portion 230 and channel portion 232.

In one example, fluid circulation channel 220 forms a fluid circulation (or recirculation) loop between fluid feed slot 208, fluid ejection chamber 202, and fluid ejection chamber 203. For example, fluid from fluid feed slot 208 circulates (or recirculates) through fluid ejection chamber 202, through fluid circulation channel 220, and through fluid ejection chamber 203 back to fluid feed slot 208. More specifically, fluid from fluid feed slot 208 circulates (or recirculates) through fluid ejection chamber 202, through channel portion 230, through channel portion 232, and through fluid ejection chamber 203 back to fluid feed slot 208.

As illustrated in the example of FIG. 2, fluid circulating element 222 is formed in, provided within, or communicated with channel portion 230 of fluid circulation channel 220, and forms an asymmetry to fluid circulation channel 220 whereby a fluid flow distance between fluid circulating element 222 and fluid ejection chamber 202 is less than a fluid flow distance between fluid circulating element 222 and fluid ejection chamber 203. As such, in one example, channel portion 230 directs fluid in a first direction, as indicated by arrow 230*a*, and channel portion 232 directs fluid in a second direction opposite the first direction, as indicated by arrow 232*b*. More specifically, in one example, fluid circulation channel 220 directs fluid in a first direction (arrow 230*a*) between fluid ejection chamber 202 and fluid ejection chamber 203, and directs fluid in a second direction (arrow 232*b*) opposite the first direction between fluid ejection chamber 202 and fluid ejection chamber 203. Thus, in one example, fluid circulating element 222 creates an average or net fluid flow in fluid circulation channel 220 between fluid ejection chamber 202 and fluid ejection chamber 203.

In one example, to provide fluid flow in the first direction indicated by arrow 230*a* and the second, opposite direction indicated by arrow 232*b*, fluid circulation channel 220 includes a channel loop 231. As such, in one example, fluid circulation channel 220 directs fluid in the first direction (arrow 230*a*) between fluid ejection chamber 202 and channel loop 231, and in the second direction (arrow 232*b*) between channel loop 231 and fluid ejection chamber 203. In one example, channel loop 231 includes a U-shaped portion of fluid circulation channel 220 such that a length (or portion) of channel portion 230 and a length (or portion) of channel portion 232 are spaced from and oriented substantially parallel with each other.

In one example, a width of channel portion 230 and a width of channel portion 232 are substantially equal. In addition, a length of channel portion 230 and a length of channel portion 232 are substantially equal. Furthermore, as illustrated in the example of FIG. 2, a width of channel portion 230 is less than a width of fluid ejection chamber 202, and a width of channel portion 232 is less than a width of fluid ejection chamber 203. In other examples, channel portions 230 and 232 (including sections, segments or regions thereof) may be of different widths, and may be of different lengths.

Figure 3:
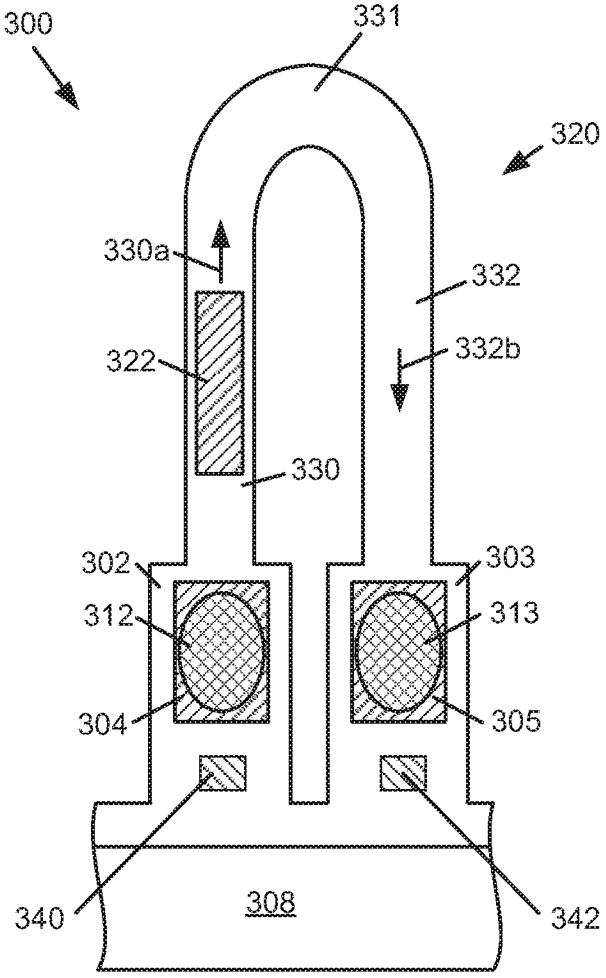
FIG. 3 is a schematic plan view illustrating an example of a portion of a fluid ejection device.

FIG. 3 is a schematic plan view illustrating an example of a portion of a fluid ejection device 300. Similar to fluid ejection device 200, fluid ejection device 300 includes a first fluid ejection chamber 302 with a corresponding drop ejecting element 304, and a second fluid ejection chamber 303 with a corresponding drop ejecting element 305, such that nozzle openings or orifices 312 and 313 communicate with respective fluid ejection chambers 302 and 303. In addition, in one example, fluid ejection device 300 includes a fluid circulation path or channel 320 with a corresponding fluid circulating element 322, with fluid circulation channel 320 including a path or channel portion 330 communicated with fluid ejection chamber 302, and a path or channel portion 332 communicated with fluid ejection chamber 303. In one example, nozzle openings or orifices 312 and 313 are each of a non-circular shape, including, for example, a non-circular bore. Although illustrated as being of the same shape and same size, nozzle openings or orifices 312 and 313, and drop ejecting elements 304 and 305, may be of different shapes, and may be of different sizes.

Similar to fluid circulation channel 220 of fluid ejection device 200, fluid circulation channel 320 of fluid ejection device 300 forms a fluid circulation (or recirculation) loop between fluid feed slot 308, fluid ejection chamber 302, and fluid ejection chamber 303. For example, fluid from fluid feed slot 308 circulates (or recirculates) through fluid ejection chamber 302, through fluid circulation channel 320, and through fluid ejection chamber 303 back to fluid feed slot 308. More specifically, fluid from fluid feed slot 308 circulates (or recirculates) through fluid ejection chamber 302, through channel portion 330, through channel portion 332, and through fluid ejection chamber 303 back to fluid feed slot 308.

In addition, and similar to fluid circulating element 222 of fluid ejection device 200, fluid circulating element 322 is formed in, provided within, or communicated with channel portion 330 of fluid circulation channel 320, and forms an asymmetry to fluid circulation channel 320 whereby a fluid flow distance between fluid circulating element 322 and fluid ejection chamber 302 is less than a fluid flow distance between fluid circulating element 322 and fluid ejection chamber 303. As such, in one example, channel portion 330 directs fluid in a first direction, as indicated by arrow 330*a*, and channel portion 332 directs fluid in a second direction opposite the first direction, as indicated by arrow 332*b*. Thus, in one example, fluid circulating element 322 creates an average or net fluid flow in fluid circulation channel 320 between fluid ejection chamber 302 and fluid ejection chamber 303. Furthermore, in one example, and similar to fluid circulation channel 220 of fluid ejection device 200, fluid circulation channel 320 includes a channel loop 331 wherein channel loop 331 includes a U-shaped portion of fluid circulation channel 320.

As illustrated in the example of FIG. 3, fluid ejection device 300 includes an object tolerant architecture 340 between fluid feed slot 308 and fluid ejection chamber 302, and an object tolerant architecture 342 between fluid feed slot 308 and between fluid ejection chamber 303. Object tolerant architecture 340 and object tolerant architecture 342 include, for example, a pillar, a column, a post or other structure (or structures). As such, object tolerant architecture 340 and object tolerant architecture 342 form "islands" which allow fluid to flow past while preventing objects, such as air bubbles or particles (e.g., dust, fibers), from flowing into fluid ejection chamber 302 from fluid feed slot 308, and into fluid ejection chamber 303 from fluid feed slot 308. Such objects, if allowed to enter fluid ejection chamber 302 or fluid ejection chamber 303, may affect the performance of fluid ejection device 300, including, for example, the performance of drop ejecting element 304 or drop ejecting element 305.

Figure 4:
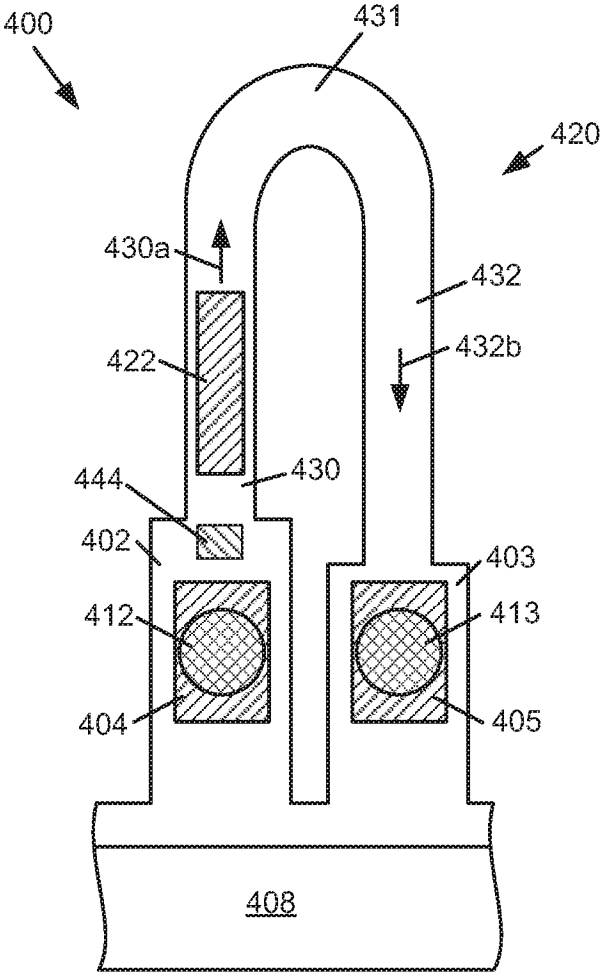
FIG. 4 is a schematic plan view illustrating an example of a portion of a fluid ejection device.

FIG. 4 is a schematic plan view illustrating an example of a portion of a fluid ejection device 400. Similar to fluid ejection device 200, fluid ejection device 400 includes a first fluid ejection chamber 402 with a corresponding drop ejecting element 404, and a second fluid ejection chamber 403 with a corresponding drop ejecting element 405, such that nozzle openings or orifices 412 and 413 communicate with respective fluid ejection chambers 402 and 403. In addition, in one example, fluid ejection device 400 includes a fluid circulation path or channel 420 with a corresponding fluid circulating element 422, with fluid circulation channel 420 including a path or channel portion 430 communicated with fluid ejection chamber 402, and a path or channel portion 432 communicated with fluid ejection chamber 403. Nozzle openings or orifices 412 and 413 may be of a circular, non-circular, or other shape. Although illustrated as being of the same shape and same size, nozzle openings or orifices 412 and 413, and drop ejecting elements 404 and 405, may be of different shapes, and may be of different sizes.

Similar to fluid circulation channel 220 of fluid ejection device 200, fluid circulation channel 420 of fluid ejection device 400 forms a fluid circulation (or recirculation) loop between fluid feed slot 408, fluid ejection chamber 402, and fluid ejection chamber 403. For example, fluid from fluid feed slot 408 circulates (or recirculates) through fluid ejection chamber 402, through fluid circulation channel 420, and through fluid ejection chamber 403 back to fluid feed slot 408. More specifically, fluid from fluid feed slot 408 circulates (or recirculates) through fluid ejection chamber 402, through channel portion 430, through channel portion 432, and through fluid ejection chamber 403 back to fluid feed slot 408.

In addition, and similar to fluid circulating element 222 of fluid ejection device 200, fluid circulating element 422 is formed in, provided within, or communicated with channel portion 430 of fluid circulation channel 420, and forms an asymmetry to fluid circulation channel 420 whereby a fluid flow distance between fluid circulating element 422 and fluid ejection chamber 402 is less than a fluid flow distance between fluid circulating element 422 and fluid ejection chamber 403. As such, in one example, channel portion 430 directs fluid in a first direction, as indicated by arrow 430*a*, and channel portion 432 directs fluid in a second direction opposite the first direction, as indicated by arrow 432*b*. Thus, in one example, fluid circulating element 422 creates an average or net fluid flow in fluid circulation channel 420 between fluid ejection chamber 402 and fluid ejection chamber 403. Furthermore, in one example, and similar to fluid circulation channel 220 of fluid ejection device 200, fluid circulation channel 420 includes a channel loop 431 wherein channel loop 431 includes a U-shaped portion of fluid circulation channel 420.

As illustrated in the example of FIG. 4, fluid ejection device 400 includes an object tolerant architecture 444. Object tolerant architecture 444 includes, for example, a pillar, a column, a post or other structure (or structures) formed or provided between fluid ejection chamber 402 and fluid circulation channel 420, including, more specifically, between drop ejecting element 404 and fluid circulating element 422. As such, object tolerant architecture 444 is provided "upstream" or before fluid circulating element 422 (relative to a direction of fluid flow through fluid circulation channel 420). In one example, object tolerant architecture 444 is formed within fluid ejection chamber 402 opposite of fluid feed slot 408.

In one example, object tolerant architecture 444 forms an "island" which allows fluid to flow past and into (or from) fluid circulation channel 420 while preventing objects, such as air bubbles or particles (e.g., dust, fibers), from flowing into (or from) fluid circulation channel 420. For example, object tolerant architecture 444 helps to prevent air bubbles and/or particles from entering fluid circulation channel 420, and entering fluid ejection chamber 403, from fluid ejection chamber 402, and helps to prevent air bubbles and/or particles from entering fluid ejection chamber 402 from fluid circulation channel 420. Such objects, if allowed to enter fluid circulation channel 420, or fluid ejection chamber 402 or fluid ejection chamber 403, may affect the performance of fluid ejection device 400, including, for example, the performance of fluid circulating element 422, or drop ejecting element 404 or drop ejecting element 405. In addition, object tolerant architecture 444 helps to increase back pressure and, therefore, increase firing momentum of the ejection of drops from fluid ejection chamber 402 by helping to contain the drive energy during drop ejection. Furthermore, object tolerant architecture 444 helps to mitigate or minimize cross-talk between fluid ejection chamber 402 and fluid ejection chamber 403, and between fluid circulating element 422 and fluid ejection chamber 402.

Figure 5:
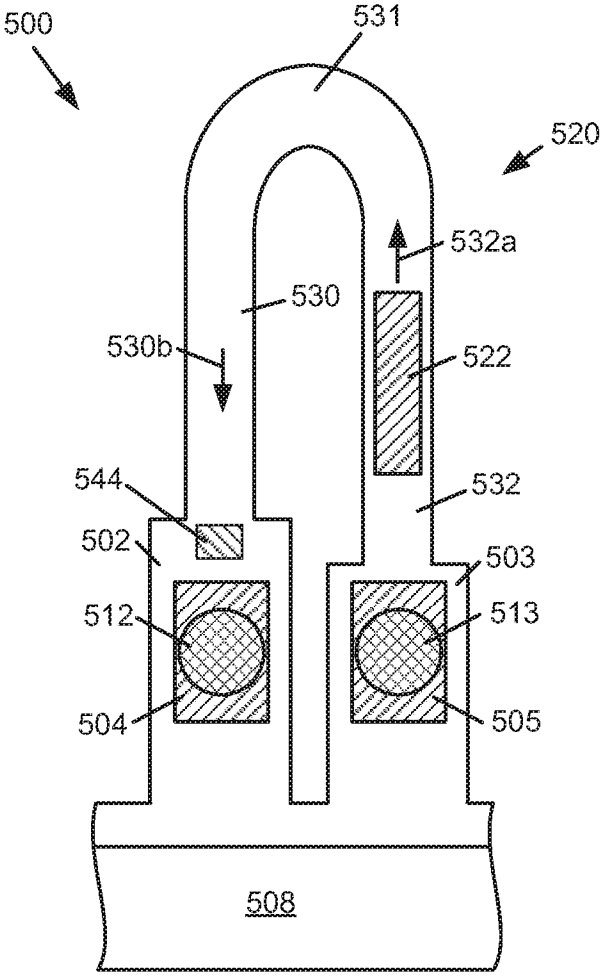
FIG. 5 is a schematic plan view illustrating an example of a portion of a fluid ejection device.

FIG. 5 is a schematic plan view illustrating an example of a portion of a fluid ejection device 500. Similar to fluid ejection device 400, fluid ejection device 500 includes a first fluid ejection chamber 502 with a corresponding drop ejecting element 504, and a second fluid ejection chamber 503 with a corresponding drop ejecting element 505, such that nozzle openings or orifices 512 and 513 communicate with respective fluid ejection chambers 502 and 503. In addition, in one example, fluid ejection device 500 includes a fluid circulation path or channel 520 with a corresponding fluid circulating element 522, with fluid circulation channel 520 including a path or channel portion 530 communicated with fluid ejection chamber 502, and a path or channel portion 532 communicated with fluid ejection chamber 503. Nozzle openings or orifices 512 and 513 may be of a circular, non-circular, or other shape. Although illustrated as being of the same shape and same size, nozzle openings or orifices 512 and 513, and drop ejecting elements 504 and 505, may be of different shapes, and may be of different sizes.

In one example, fluid circulation channel 520 forms a fluid circulation (or recirculation) loop between fluid feed slot 508, fluid ejection chamber 503, and fluid ejection chamber 502. For example, fluid from fluid feed slot 508 circulates (or recirculates) through fluid ejection chamber 503, through fluid circulation channel 520, and through fluid ejection chamber 502 back to fluid feed slot 508. More specifically, fluid from fluid feed slot 508 circulates (or recirculates) through fluid ejection chamber 503, through channel portion 532, through channel portion 530, and through fluid ejection chamber 502 back to fluid feed slot 508. In one example, and similar to fluid circulation channel 420 of fluid ejection device 400, fluid circulation channel 520 includes a channel loop 531 wherein channel loop 531 includes a U-shaped portion of fluid circulation channel 520.

As illustrated in the example of FIG. 5, fluid circulating element 522 is formed in, provided within, or communicated with channel portion 532 of fluid circulation channel 520, and forms an asymmetry to fluid circulation channel 520 whereby a fluid flow distance between fluid circulating element 522 and fluid ejection chamber 503 is less than a fluid flow distance between fluid circulating element 522 and fluid ejection chamber 502. As such, in one example, channel portion 532 directs fluid in a first direction, as indicated by arrow 532*a*, and channel portion 530 directs fluid in a second direction opposite the first direction, as indicated by arrow 530*b*. More specifically, in one example, fluid circulation channel 520 directs fluid in a first direction (arrow 532*a*) between fluid ejection chamber 503 and fluid ejection chamber 502, and directs fluid in a second direction (arrow 530*b*) opposite the first direction between fluid ejection chamber 503 and fluid ejection chamber 502, including in the first direction (arrow 532*a*) between fluid ejection chamber 503 and channel loop 531, and in the second direction (arrow 530*b*) between channel loop 531 and fluid ejection chamber 502. Thus, in one example, fluid circulating element 522 creates an average or net fluid flow in fluid circulation channel 520 between fluid ejection chamber 503 and fluid ejection chamber 502.

In one example, fluid ejection device 500 includes an object tolerant architecture 544. Object tolerant architecture 544 includes, for example, a pillar, a column, a post or other structure (or structures) formed or provided between fluid circulation channel 520 and fluid ejection chamber 503, including, more specifically, between fluid circulating element 522 and drop ejecting element 504. As such, object tolerant architecture 544 is provided "downstream" or after fluid circulating element 522 (relative to a direction of fluid flow through fluid circulation channel 520). In one example, object tolerant architecture 544 is formed within fluid ejection chamber 502 opposite of fluid feed slot 508.

In one example, object tolerant architecture 544 forms an "island" which allows fluid to flow past and from (or into) fluid circulation channel 520 while preventing objects, such as air bubbles or particles (e.g., dust, fibers), from flowing from (or into) fluid circulation channel 520. For example, object tolerant architecture 544 helps to prevent air bubbles and/or particles from entering fluid ejection chamber 502 from fluid circulation channel 520, and helps to prevent air bubbles and/or particles from entering fluid circulation channel 520, and entering fluid ejection chamber 503, from fluid ejection chamber 502. Such objects, if allowed to enter fluid ejection chamber 502 or fluid ejection chamber 503, or fluid circulation channel 520, may affect the performance of fluid ejection device 500, including, for example, the performance of drop ejecting element 504 or drop ejecting element 505, or fluid circulating element 522. In addition, object tolerant architecture 544 helps to increase back pressure and, therefore, increase firing momentum of the ejection of drops from fluid ejection chamber 502 by helping to contain the drive energy during drop ejection. Furthermore, object tolerant architecture 544 helps to mitigate or minimize cross-talk between fluid ejection chamber 502 and fluid ejection chamber 503, and between fluid circulating element 522 and fluid ejection chamber 502.

Figure 6:
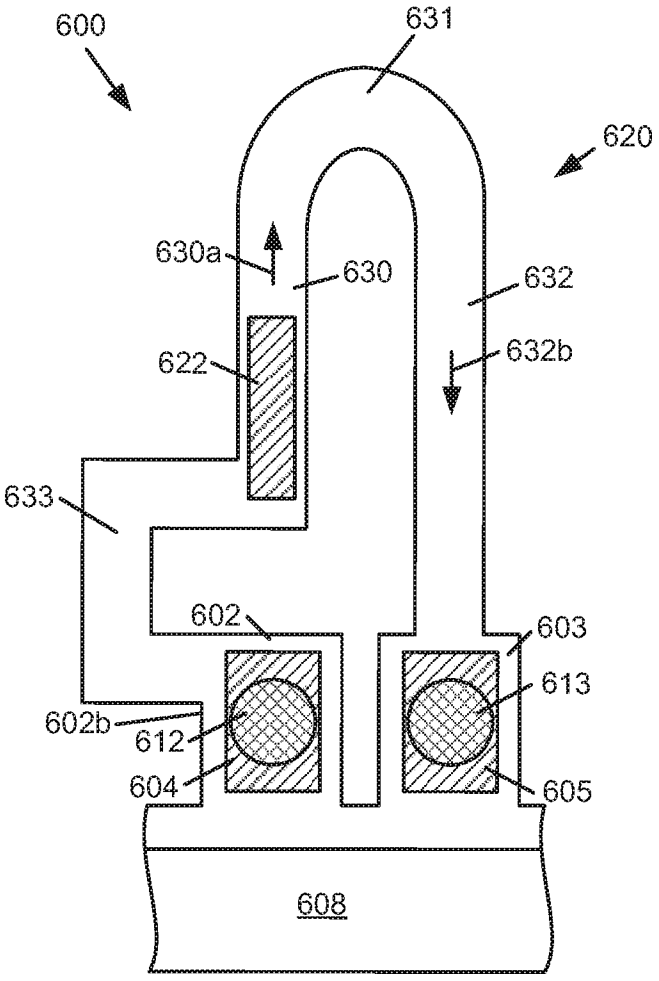
FIG. 6 is a schematic plan view illustrating an example of a portion of a fluid ejection device.

FIG. 6 is a schematic plan view illustrating an example of a portion of a fluid ejection device 600. Similar to fluid ejection device 200, fluid ejection device 600 includes a first fluid ejection chamber 602 with a corresponding drop ejecting element 604, and a second fluid ejection chamber 603 with a corresponding drop ejecting element 605, such that nozzle openings or orifices 612 and 613 communicate with respective fluid ejection chambers 602 and 603. In addition, in one example, fluid ejection device 600 includes a fluid circulation path or channel 620 with a corresponding fluid circulating element 622, with fluid circulation channel 620 including a path or channel portion 630 communicated with fluid ejection chamber 602, and a path or channel portion 632 communicated with fluid ejection chamber 603. Nozzle openings or orifices 612 and 613 may be of a circular, non-circular, or other shape. Although illustrated as being of the same shape and same size, nozzle openings or orifices 612 and 613, and drop ejecting elements 604 and 605, may be of different shapes, and may be of different sizes.

Similar to fluid circulation channel 220 of fluid ejection device 200, fluid circulation channel 620 of fluid ejection device 600 forms a fluid circulation (or recirculation) loop between fluid feed slot 608, fluid ejection chamber 602, and fluid ejection chamber 603. For example, fluid from fluid feed slot 608 circulates (or recirculates) through fluid ejection chamber 602, through fluid circulation channel 620, and through fluid ejection chamber 603 back to fluid feed slot 608. More specifically, fluid from fluid feed slot 608 circulates (or recirculates) through fluid ejection chamber 602, through channel portion 630, through channel portion 632, and through fluid ejection chamber 603 back to fluid feed slot 608.

In addition, and similar to fluid circulating element 222 of fluid ejection device 200, fluid circulating element 622 is formed in, provided within, or communicated with channel portion 630 of fluid circulation channel 620, and forms an asymmetry to fluid circulation channel 620 whereby a fluid flow distance between fluid circulating element 622 and fluid ejection chamber 602 is less than a fluid flow distance between fluid circulating element 622 and fluid ejection chamber 603. As such, in one example, channel portion 630 directs fluid in a first direction, as indicated by arrow 630*a*, and channel portion 632 directs fluid in a second direction opposite the first direction, as indicated by arrow 632*b*. Thus, in one example, fluid circulating element 622 creates an average or net fluid flow in fluid circulation channel 620 between fluid ejection chamber 602 and fluid ejection chamber 603. Furthermore, in one example, and similar to fluid circulation channel 220 of fluid ejection device 200, fluid circulation channel 620 includes a channel loop 631 wherein channel loop 631 includes a U-shaped portion of fluid circulation channel 620.

As illustrated in the example of FIG. 6, channel portion 630 of fluid circulation channel 620 includes an extension 633 to create a "long" or "extended length" path (as compared, for example, to channel portion 230 of fluid circulation channel 220). More specifically, in one example, channel portion 630 communicates with fluid ejection chamber 602 at side 602*b* such that a length of channel portion 630 between fluid ejection chamber 602 and fluid ejection chamber 603, including, more specifically, a length of channel portion 630 between fluid circulating element 622 and fluid ejection chamber 602, is increased. As such, a length of channel portion 630 (as including extension 633) is greater than a length of channel portion 632. Increasing the length of channel portion 630 between fluid ejection chamber 602 and fluid ejection chamber 603 helps to "de-couple" fluid ejection chamber 602 from fluid ejection chamber 603 and mitigate cross-talk between fluid ejection chamber 602 and fluid ejection chamber 603. In addition, increasing the length of channel portion 630 between fluid circulating element 622 and fluid ejection chamber 602 helps to "de-couple" fluid circulating element 622 from fluid ejection chamber 602 and mitigate cross-talk between fluid circulating element 622 and fluid ejection chamber 602. Although illustrated as including right-angle sections, extension 633 may include curved or other non-curved sections.

Figure 7:
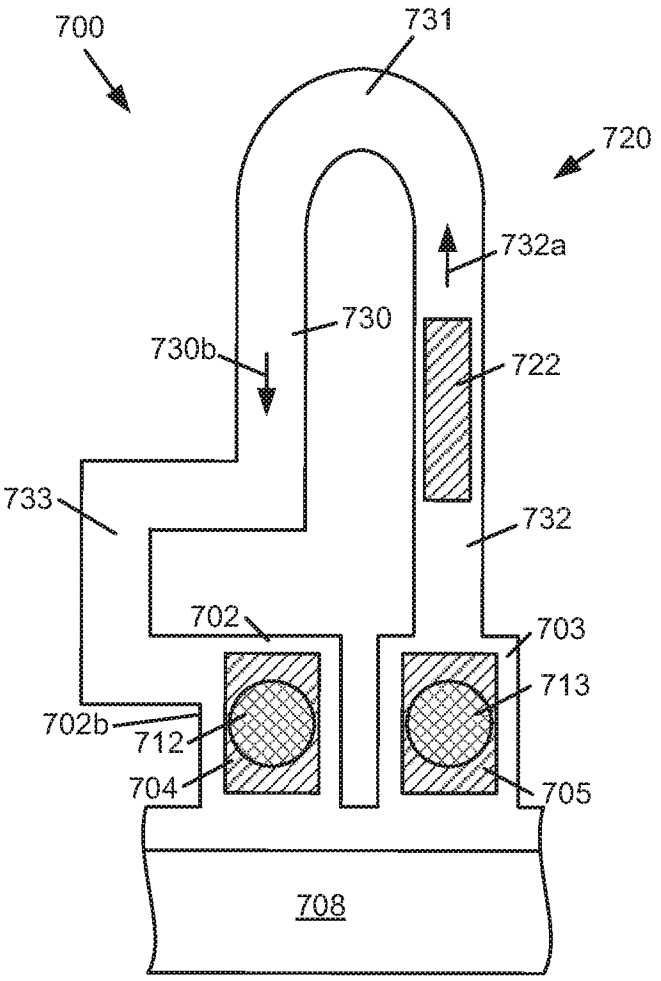
FIG. 7 is a schematic plan view illustrating an example of a portion of a fluid ejection device.

FIG. 7 is a schematic plan view illustrating an example of a portion of a fluid ejection device 700. Similar to fluid ejection device 600, fluid ejection device 700 includes a first fluid ejection chamber 702 with a corresponding drop ejecting element 704, and a second fluid ejection chamber 703 with a corresponding drop ejecting element 705, such that nozzle openings or orifices 712 and 713 communicate with respective fluid ejection chambers 702 and 703. In addition, in one example, fluid ejection device 700 includes a fluid circulation path or channel 720 with a corresponding fluid circulating element 722, with fluid circulation channel 720 including a path or channel portion 730 communicated with fluid ejection chamber 702, and a path or channel portion 732 communicated with fluid ejection chamber 703. Nozzle openings or orifices 712 and 713 may be of a circular, non-circular, or other shape. Although illustrated as being of the same shape and same size, nozzle openings or orifices 712 and 713, and drop ejecting elements 704 and 705, may be of different shapes, and may be of different sizes.

In one example, fluid circulation channel 720 forms a fluid circulation (or recirculation) loop between fluid feed slot 708, fluid ejection chamber 703, and fluid ejection chamber 702. For example, fluid from fluid feed slot 708 circulates (or recirculates) through fluid ejection chamber 703, through fluid circulation channel 720, and through fluid ejection chamber 702 back to fluid feed slot 708. More specifically, fluid from fluid feed slot 708 circulates (or recirculates) through fluid ejection chamber 703, through channel portion 732, through channel portion 730, and through fluid ejection chamber 702 back to fluid feed slot 708. In one example, and similar to fluid circulation channel 620 of fluid ejection device 600, fluid circulation channel 720 includes a channel loop 731 wherein channel loop 731 includes a U-shaped portion of fluid circulation channel 720.

As illustrated in the example of FIG. 7, fluid circulating element 722 is formed in, provided within, or communicated with channel portion 732 of fluid circulation channel 720, and forms an asymmetry to fluid circulation channel 720 whereby a fluid flow distance between fluid circulating element 722 and fluid ejection chamber 703 is less than a fluid flow distance between fluid circulating element 722 and fluid ejection chamber 702. As such, in one example, channel portion 732 directs fluid in a first direction, as indicated by arrow 732*a*, and channel portion 730 directs fluid in a second direction opposite the first direction, as indicated by arrow 730*b*. More specifically, in one example, fluid circulation channel 720 directs fluid in a first direction (arrow 732*a*) between fluid ejection chamber 703 and fluid ejection chamber 702, and directs fluid in a second direction (arrow 730*b*) opposite the first direction between fluid ejection chamber 703 and fluid ejection chamber 702, including in the first direction (arrow 732*a*) between fluid ejection chamber 703 and channel loop 731, and in the second direction (arrow 730*b*) between channel loop 731 and fluid ejection chamber 702. Thus, in one example, fluid circulating element 722 creates an average or net fluid flow in fluid circulation channel 720 between fluid ejection chamber 703 and fluid ejection chamber 702.

In one example, and similar to channel portion 630 of fluid ejection device 600, channel portion 730 includes an extension 733 to create a "long" or "extended length" path (as compared, for example, to channel portion 230 of fluid circulation channel 220). More specifically, in one example, channel portion 730 communicates with fluid ejection chamber 702 at side 702*b* such that a length of channel portion 730 between fluid ejection chamber 702 and fluid ejection chamber 703, including, more specifically, a length of channel portion 730 between fluid circulating element 722 and fluid ejection chamber 702, is increased. As such, a length of channel portion 730 (as including extension 733) is greater than a length of channel portion 732. Increasing the length of channel portion 730 between fluid ejection chamber 702 and fluid ejection chamber 703 helps to "de-couple" fluid ejection chamber 702 from fluid ejection chamber 703 and mitigate cross-talk between fluid ejection chamber 702 and fluid ejection chamber 703. In addition, increasing the length of channel portion 730 between fluid circulating element 722 and fluid ejection chamber 702 helps to "de-couple" fluid circulating element 722 from fluid ejection chamber 702 and mitigate cross-talk between fluid circulating element 722 and fluid ejection chamber 702. Although illustrated as including right-angle sections, extension 733 may include curved or other non-curved sections.

Figure 8:
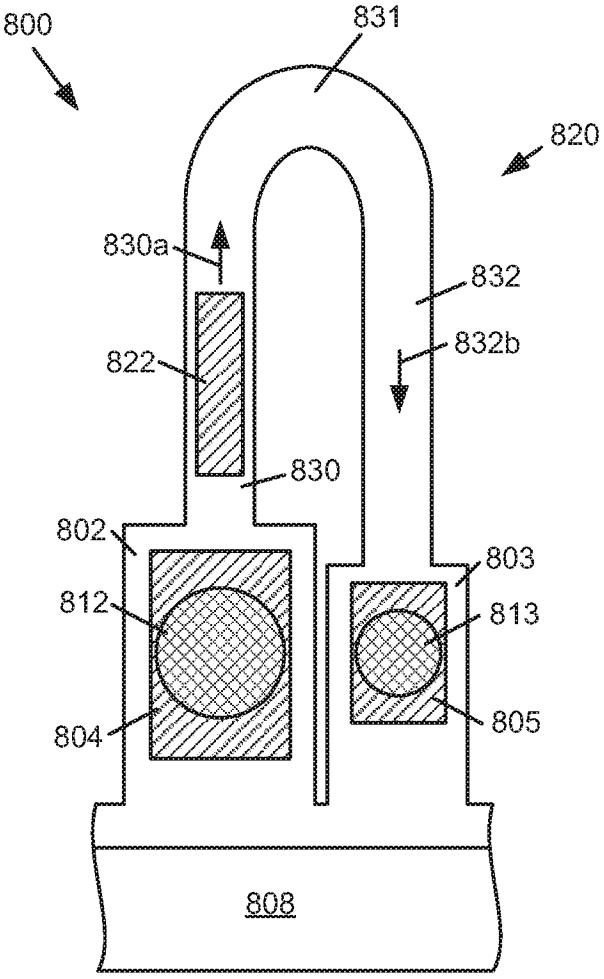
FIG. 8 is a schematic plan view illustrating an example of a portion of a fluid ejection device.

FIG. 8 is a schematic plan view illustrating an example of a portion of a fluid ejection device 800. Similar to fluid ejection device 200, fluid ejection device 800 includes a first fluid ejection chamber 802 with a corresponding drop ejecting element 804, and a second fluid ejection chamber 803 with a corresponding drop ejecting element 805, such that nozzle openings or orifices 812 and 813 communicate with respective fluid ejection chambers 802 and 803. In addition, in one example, fluid ejection device 800 includes a fluid circulation path or channel 820 with a corresponding fluid circulating element 822, with fluid circulation channel 820 including a path or channel portion 830 communicated with fluid ejection chamber 802, and a path or channel portion 832 communicated with fluid ejection chamber 803. Nozzle openings or orifices 812 and 813 may be of a circular, non-circular, or other shape. Although illustrated as being of the same shape, nozzle openings or orifices 812 and 813 may be of different shapes.

Similar to fluid circulation channel 220 of fluid ejection device 200, fluid circulation channel 820 of fluid ejection device 800 forms a fluid circulation (or recirculation) loop between fluid feed slot 808, fluid ejection chamber 802, and fluid ejection chamber 803. For example, fluid from fluid feed slot 808 circulates (or recirculates) through fluid ejection chamber 802, through fluid circulation channel 820, and through fluid ejection chamber 803 back to fluid feed slot 808. More specifically, fluid from fluid feed slot 808 circulates (or recirculates) through fluid ejection chamber 802, through channel portion 830, through channel portion 832, and through fluid ejection chamber 803 back to fluid feed slot 808.

In addition, and similar to fluid circulating element 222 of fluid ejection device 200, fluid circulating element 822 is formed in, provided within, or communicated with channel portion 830 of fluid circulation channel 820, and forms an asymmetry to fluid circulation channel 820 whereby a fluid flow distance between fluid circulating element 822 and fluid ejection chamber 802 is less than a fluid flow distance between fluid circulating element 822 and fluid ejection chamber 803. As such, in one example, channel portion 830 directs fluid in a first direction, as indicated by arrow 830*a*, and channel portion 832 directs fluid in a second direction opposite the first direction, as indicated by arrow 832*b*. Thus, in one example, fluid circulating element 822 creates an average or net fluid flow in fluid circulation channel 820 between fluid ejection chamber 802 and fluid ejection chamber 803. Furthermore, in one example, and similar to fluid circulation channel 220 of fluid ejection device 200, fluid circulation channel 820 includes a channel loop 831 wherein channel loop 831 includes a U-shaped portion of fluid circulation channel 820.

In the example illustrated in FIG. 8, nozzle openings or orifices 812 and 813, and drop ejecting elements 804 and 805, are of different sizes. In addition, corresponding fluid ejection chambers 802 and 803 are of different sizes. Providing nozzle openings or orifices 812 and 813 with different sizes enables ejection of different drop sizes (weights) from respective fluid ejection chambers 802 and 803. In addition, drop ejecting elements 804 and 805 may be operated separately or individually at different moments of time (for example, sequentially) to produce drops of different sizes (weights), or operated simultaneously to produce a combined drop of a combined size (weight).

In one example, nozzle opening or orifice 812 is larger than nozzle opening or orifice 813 such that nozzle opening or orifice 812 forms a "high" drop weight nozzle and nozzle opening or orifice 813 forms a "low" drop weight nozzle. In addition, fluid circulating element 822 is formed in, provided within, or communicated with channel portion 830 (as communicated with fluid ejection chamber 802) such that fluid circulating element 822 forms a "high" drop weight pump and, in one example, circulates fluid from fluid ejection chamber 802 (with high drop weight nozzle 812) to fluid ejection chamber 803 (with low drop weight nozzle 813).

Figure 9:
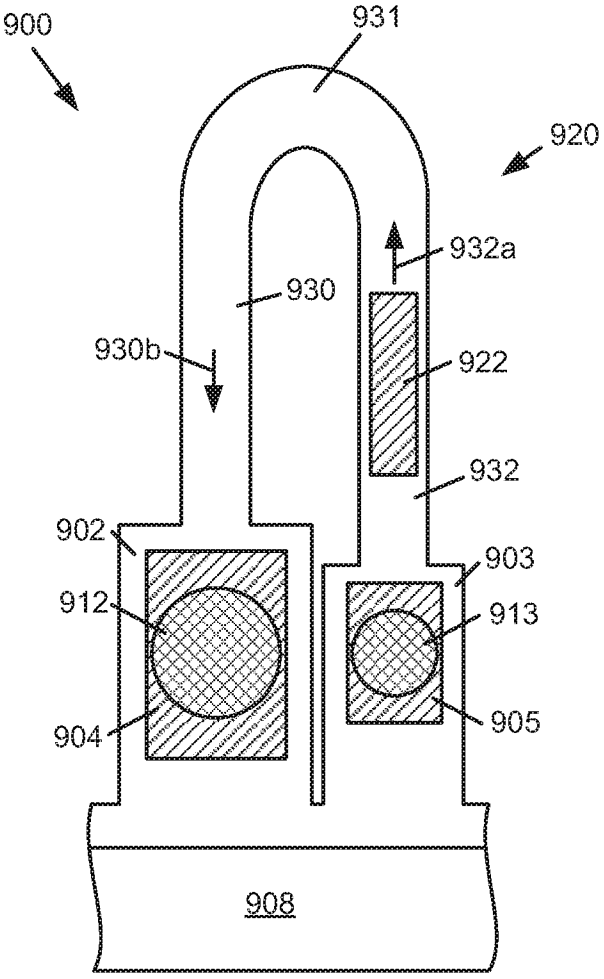
FIG. 9 is a schematic plan view illustrating an example of a portion of a fluid ejection device.

FIG. 9 is a schematic plan view illustrating an example of a portion of a fluid ejection device 900. Similar to fluid ejection device 800, fluid ejection device 900 includes a first fluid ejection chamber 902 with a corresponding drop ejecting element 904, and a second fluid ejection chamber 903 with a corresponding drop ejecting element 905, such that nozzle openings or orifices 912 and 913 communicate with respective fluid ejection chambers 902 and 903. In addition, in one example, fluid ejection device 900 includes a fluid circulation path or channel 920 with a corresponding fluid circulating element 922, with fluid circulation channel 920 including a path or channel portion 930 communicated with fluid ejection chamber 902, and a path or channel portion 932 communicated with fluid ejection chamber 903. Nozzle openings or orifices 912 and 913 may be of a circular, non-circular, or other shape. Although illustrated as being of the same shape, nozzle openings or orifices 912 and 913 may be of different shapes.

In one example, fluid circulation channel 920 forms a fluid circulation (or recirculation) loop between fluid feed slot 908, fluid ejection chamber 903, and fluid ejection chamber 902. For example, fluid from fluid feed slot 908 circulates (or recirculates) through fluid ejection chamber 903, through fluid circulation channel 920, and through fluid ejection chamber 902 back to fluid feed slot 908. More specifically, fluid from fluid feed slot 908 circulates (or recirculates) through fluid ejection chamber 903, through channel portion 932, through channel portion 930, and through fluid ejection chamber 902 back to fluid feed slot 908. In one example, and similar to fluid circulation channel 820 of fluid ejection device 800, fluid circulation channel 920 includes a channel loop 931 wherein channel loop 931 includes a U-shaped portion of fluid circulation channel 920.

As illustrated in the example of FIG. 9, fluid circulating element 922 is formed in, provided within, or communicated with channel portion 932 of fluid circulation channel 920, and forms an asymmetry to fluid circulation channel 920 whereby a fluid flow distance between fluid circulating element 922 and fluid ejection chamber 903 is less than a fluid flow distance between fluid circulating element 922 and fluid ejection chamber 902. As such, in one example, channel portion 932 directs fluid in a first direction, as indicated by arrow 932*a*, and channel portion 930 directs fluid in a second direction opposite the first direction, as indicated by arrow 930*b*. More specifically, in one example, fluid circulation channel 920 directs fluid in a first direction (arrow 932*a*) between fluid ejection chamber 903 and fluid ejection chamber 902, and directs fluid in a second direction (arrow 930*b*) opposite the first direction between fluid ejection chamber 903 and fluid ejection chamber 902, including in the first direction (arrow 932*a*) between fluid ejection chamber 903 and channel loop 931, and in the second direction (arrow 930*b*) between channel loop 931 and fluid ejection chamber 902. Thus, in one example, fluid circulating element 922 creates an average or net fluid flow in fluid circulation channel 920 between fluid ejection chamber 903 and fluid ejection chamber 902.

Similar to nozzle openings or orifices 812 and 813 of fluid ejection device 800, nozzle openings or orifices 912 and 913, and drop ejecting elements 904 and 905, are of different sizes. In addition, corresponding fluid ejection chambers 902 and 903 are of different sizes.

In one example, nozzle opening or orifice 912 is larger than nozzle opening or orifice 913 such that nozzle opening or orifice 912 forms a "high" drop weight nozzle and nozzle opening or orifice 913 forms a "low" drop weight nozzle. In addition, fluid circulating element 922 is formed in, provided within, or communicated with channel portion 932 (as communicated with fluid ejection chamber 903) such that fluid circulating element 922 forms a "low" drop weight pump and, in one example, circulates fluid from fluid ejection chamber 903 (with low drop weight nozzle 913) to fluid ejection chamber 902 (with high drop weight nozzle 912).

Figure 10:
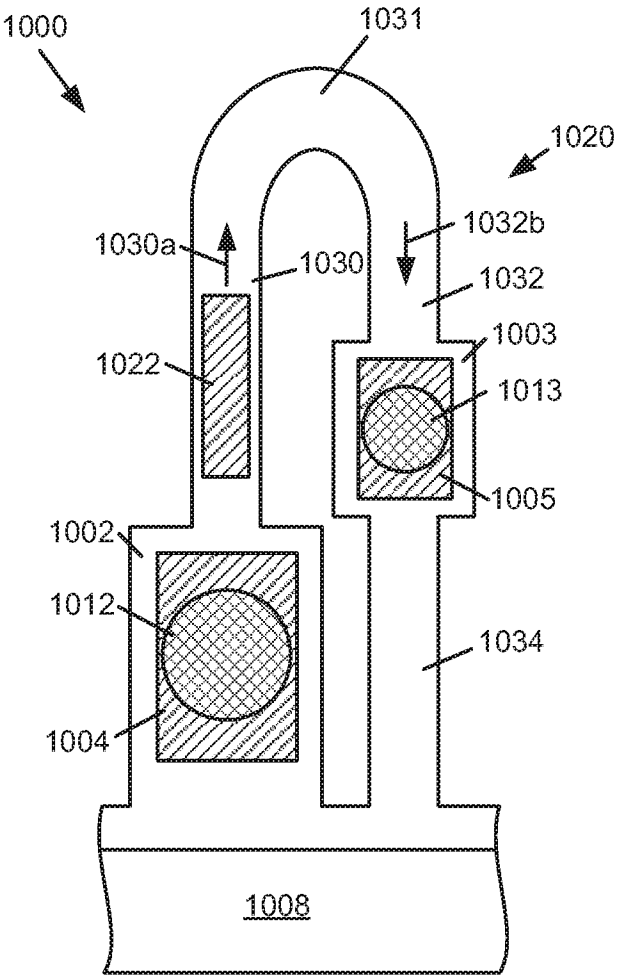
FIG. 10 is a schematic plan view illustrating an example of a portion of a fluid ejection device.

FIG. 10 is a schematic plan view illustrating an example of a portion of a fluid ejection device 1000. Similar to fluid ejection device 800, fluid ejection device 1000 includes a first fluid ejection chamber 1002 with a corresponding drop ejecting element 1004, and a second fluid ejection chamber 1003 with a corresponding drop ejecting element 1005, such that nozzle openings or orifices 1012 and 1013 communicate with respective fluid ejection chambers 1002 and 1003. In addition, in one example, fluid ejection device 1000 includes a fluid circulation path or channel 1020 with a corresponding fluid circulating element 1022, with fluid circulation channel 1020 including a path or channel portion 1030 communicated with fluid ejection chamber 1002, and a path or channel portion 1032 communicated with fluid ejection chamber 1003. Nozzle openings or orifices 1012 and 1013 may be of a circular, non-circular, or other shape. Although illustrated as being of the same shape, nozzle openings or orifices 1012 and 1013 may be of different shapes.

As illustrated in the example of FIG. 10, fluid injection chamber 1003 and nozzle opening or orifice 1013 are offset from fluid feed slot 1008 such that fluid circulation channel 1020 further includes a path or channel portion 1034 communicated with and extended between fluid feed slot 1008 and fluid injection chamber 1003. As such, in one example, fluid circulation channel 1020 of fluid ejection device 1000 forms a fluid circulation (or recirculation) loop between fluid feed slot 1008, fluid ejection chamber 1002, and fluid ejection chamber 1003. For example, fluid from fluid feed slot 1008 circulates (or recirculates) through fluid ejection chamber 1002, through fluid circulation channel 1020, and through fluid ejection chamber 1003 back to fluid feed slot 1008. More specifically, fluid from fluid feed slot 1008 circulates (or recirculates) through fluid ejection chamber 1002, through channel portion 1030, through channel portion 1032, through fluid ejection chamber 1003, and through channel portion 1034 back to fluid feed slot 1008.

In addition, and similar to fluid circulating element 222 of fluid ejection device 200, fluid circulating element 1022 is formed in, provided within, or communicated with channel portion 1030 of fluid circulation channel 1020, and forms an asymmetry to fluid circulation channel 1020 whereby a fluid flow distance between fluid circulating element 1022 and fluid ejection chamber 1002 is less than a fluid flow distance between fluid circulating element 1022 and fluid ejection chamber 1003. As such, in one example, channel portion 1030 directs fluid in a first direction, as indicated by arrow 1030*a*, and channel portion 1032 directs fluid in a second direction opposite the first direction, as indicated by arrow 1032*b*. Thus, in one example, fluid circulating element 1022 creates an average or net fluid flow in fluid circulation channel 1020 between fluid ejection chamber 1002 and fluid ejection chamber 1003. Furthermore, in one example, and similar to fluid circulation channel 220 of fluid ejection device 200, fluid circulation channel 1020 includes a channel loop 1031 wherein channel loop 1031 includes a U-shaped portion of fluid circulation channel 1020.

Similar to nozzle openings or orifices 812 and 813 of fluid ejection device 800, nozzle openings or orifices 1012 and 1013, and drop ejecting elements 1004 and 1005, are of different sizes. In addition, corresponding fluid ejection chambers 1002 and 1003 are of different sizes.

In one example, nozzle opening or orifice 1012 is larger than nozzle opening or orifice 1013 such that nozzle opening or orifice 1012 forms a "high" drop weight nozzle and nozzle opening or orifice 1013 forms a "low" drop weight nozzle. In addition, fluid circulating element 1022 is formed in, provided within, or communicated with channel portion 1030 (as communicated with fluid ejection chamber 1002) such that fluid circulating element 1022 forms a "high" drop weight pump and, in one example, circulates fluid from fluid ejection chamber 1002 (with high drop weight nozzle 1012) to fluid ejection chamber 1003 (with low drop weight nozzle 1013). In addition, with fluid ejection chamber 1003 (and low drop weight nozzle 1013) offset from fluid feed slot 1008, a "low" drop weight offset is formed.

Figure 11:
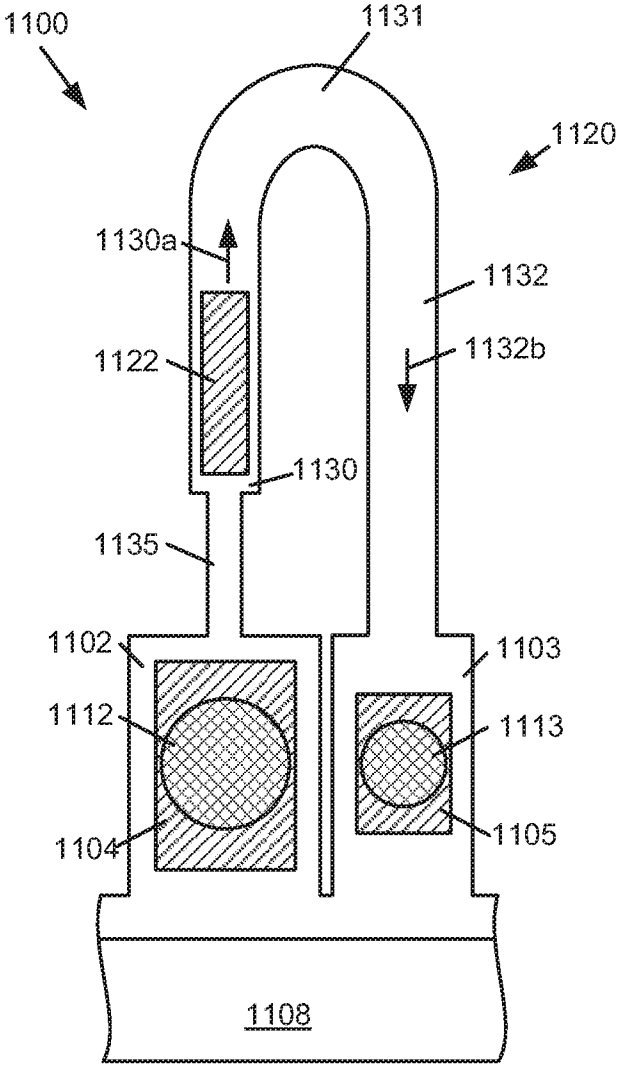
FIG. 11 is a schematic plan view illustrating an example of a portion of a fluid ejection device.

FIG. 11 is a schematic plan view illustrating an example of a portion of a fluid ejection device 1100. Similar to fluid ejection device 800, fluid ejection device 1100 includes a first fluid ejection chamber 1102 with a corresponding drop ejecting element 1104, and a second fluid ejection chamber 1103 with a corresponding drop ejecting element 1105, such that nozzle openings or orifices 1112 and 1113 communicate with respective fluid ejection chambers 1102 and 1103. In addition, in one example, fluid ejection device 1100 includes a fluid circulation path or channel 1120 with a corresponding fluid circulating element 1122, with fluid circulation channel 1120 including a path or channel portion 1130 communicated with fluid ejection chamber 1102, and a path or channel portion 1132 communicated with fluid ejection chamber 1103. Nozzle openings or orifices 1112 and 1113 may be of a circular, non-circular, or other shape.

Similar to fluid circulation channel 820 of fluid ejection device 800, fluid circulation channel 1120 of fluid ejection device 1100 forms a fluid circulation (or recirculation) loop between fluid feed slot 1108, fluid ejection chamber 1102, and fluid ejection chamber 1103. For example, fluid from fluid feed slot 1108 circulates (or recirculates) through fluid ejection chamber 1102, through fluid circulation channel 1120, and through fluid ejection chamber 1103 back to fluid feed slot 1108. More specifically, fluid from fluid feed slot 1108 circulates (or recirculates) through fluid ejection chamber 1102, through channel portion 1130, through channel portion 1132, and through fluid ejection chamber 1103 back to fluid feed slot 1108.

In addition, and similar to fluid circulating element 822 of fluid ejection device 800, fluid circulating element 1122 is formed in, provided within, or communicated with channel portion 1130 of fluid circulation channel 1120, and forms an asymmetry to fluid circulation channel 1120 whereby a fluid flow distance between fluid circulating element 1122 and fluid ejection chamber 1102 is less than a fluid flow distance between fluid circulating element 1122 and fluid ejection chamber 1103. As such, in one example, channel portion 1130 directs fluid in a first direction, as indicated by arrow 1130*a*, and channel portion 1132 directs fluid in a second direction opposite the first direction, as indicated by arrow 1132*b*. Thus, in one example, fluid circulating element 1122 creates an average or net fluid flow in fluid circulation channel 1120 between fluid ejection chamber 1102 and fluid ejection chamber 1103. Furthermore, in one example, and similar to fluid circulation channel 820 of fluid ejection device 800, fluid circulation channel 1120 includes a channel loop 1131 wherein channel loop 1131 includes a U-shaped portion of fluid circulation channel 1120.

As illustrated in the example of FIG. 11, channel portion 1130 of fluid circulation channel 1120 includes a "pinch" or narrowed portion 1135 (as compared, for example, to channel portion 830 of fluid circulation channel 820). More specifically, in one example, narrowed portion 1135 is formed in a section or length of channel portion 1130 between fluid ejection chamber 1102 and fluid ejection chamber 1103, including, more specifically, a section or length of channel portion 1130 between fluid ejection chamber 1102 and fluid circulating element 1122. Providing narrowed portion 1135 between fluid ejection chamber 1102 and fluid ejection chamber 1103 helps to "de-couple" fluid ejection chamber 1102 from fluid ejection chamber 1103 and mitigate cross-talk between fluid ejection chamber 1102 and fluid ejection chamber 1103. In addition, providing narrowed portion 1135 between fluid circulating element 1122 and fluid ejection chamber 1102 helps to "de-couple" fluid circulating element 1122 from fluid ejection chamber 1102 and mitigate cross-talk between fluid circulating element 1122 and fluid ejection chamber 1102. Furthermore, providing narrowed portion 1135 between fluid circulating element 1122 and fluid ejection chamber 1102 helps to control a direction of pumping and prevent "blowback" toward fluid ejection chamber 1102.

Figure 12:
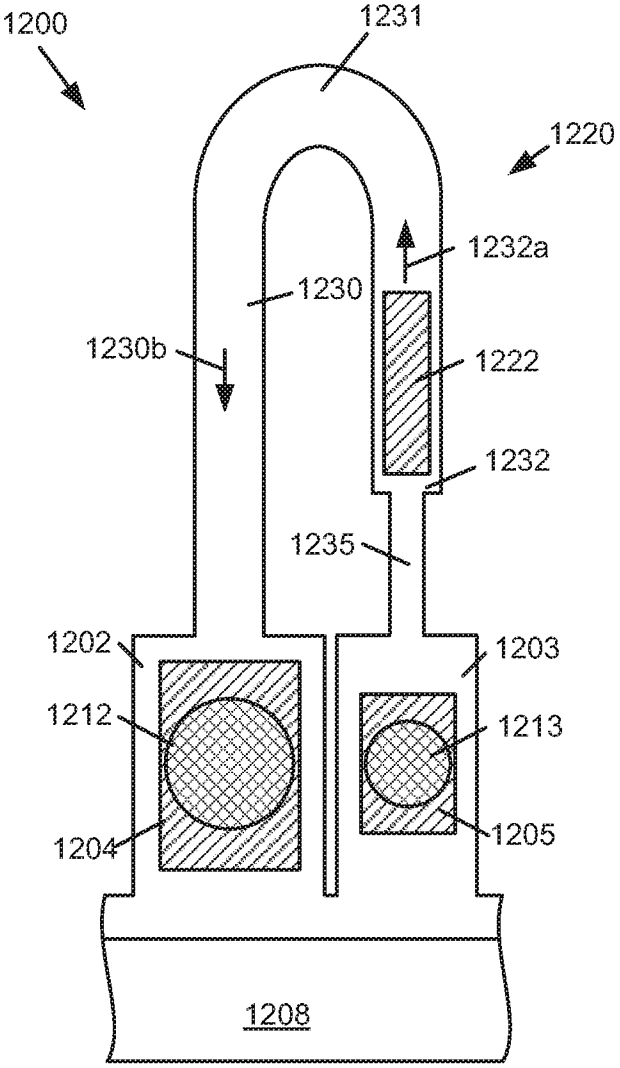
FIG. 12 is a schematic plan view illustrating an example of a portion of a fluid ejection device.

FIG. 12 is a schematic plan view illustrating an example of a portion of a fluid ejection device 1200. Similar to fluid ejection device 1100, fluid ejection device 1200 includes a first fluid ejection chamber 1202 with a corresponding drop ejecting element 1204, and a second fluid ejection chamber 1203 with a corresponding drop ejecting element 1205, such that nozzle openings or orifices 1212 and 1213 communicate with respective fluid ejection chambers 1202 and 1203. In addition, in one example, fluid ejection device 1200 includes a fluid circulation path or channel 1220 with a corresponding fluid circulating element 1222, with fluid circulation channel 1220 including a path or channel portion 1230 communicated with fluid ejection chamber 1202, and a path or channel portion 1232 communicated with fluid ejection chamber 1203. Nozzle openings or orifices 1212 and 1213 may be of a circular, non-circular, or other shape.

In one example, fluid circulation channel 1220 forms a fluid circulation (or recirculation) loop between fluid feed slot 1208, fluid ejection chamber 1203, and fluid ejection chamber 1202. For example, fluid from fluid feed slot 1208 circulates (or recirculates) through fluid ejection chamber 1203, through fluid circulation channel 1220, and through fluid ejection chamber 1202 back to fluid feed slot 1208. More specifically, fluid from fluid feed slot 1208 circulates (or recirculates) through fluid ejection chamber 1203, through channel portion 1232, through channel portion 1230, and through fluid ejection chamber 1202 back to fluid feed slot 1208. In one example, and similar to fluid circulation channel 1120 of fluid ejection device 1100, fluid circulation channel 1220 includes a channel loop 1231 wherein channel loop 1231 includes a U-shaped portion of fluid circulation channel 1220.

As illustrated in the example of FIG. 12, fluid circulating element 1222 is formed in, provided within, or communicated with channel portion 1232 of fluid circulation channel 1220, and forms an asymmetry to fluid circulation channel 1220 whereby a fluid flow distance between fluid circulating element 1222 and fluid ejection chamber 1203 is less than a fluid flow distance between fluid circulating element 1222 and fluid ejection chamber 1202. As such, in one example, channel portion 1232 directs fluid in a first direction, as indicated by arrow 1232*a*, and channel portion 1230 directs fluid in a second direction opposite the first direction, as indicated by arrow 1230*b*. More specifically, in one example, fluid circulation channel 1220 directs fluid in a first direction (arrow 1232*a*) between fluid ejection chamber 1203 and fluid ejection chamber 1202, and directs fluid in a second direction (arrow 1230*b*) opposite the first direction between fluid ejection chamber 1203 and fluid ejection chamber 1202, including in the first direction (arrow 1232*a*) between fluid ejection chamber 1203 and channel loop 1231, and in the second direction (arrow 1230*b*) between channel loop 1231 and fluid ejection chamber 1202. Thus, in one example, fluid circulating element 1222 creates an average or net fluid flow in fluid circulation channel 1220 between fluid ejection chamber 1203 and fluid ejection chamber 1202.

In one example, and similar to channel portion 1130 of fluid ejection device 1100, channel portion 1232 of fluid circulation channel 1220 includes a "pinch" or narrowed portion 1235 (as compared, for example, to channel portion 932 of fluid circulation channel 920). More specifically, in one example, narrowed portion 1235 is formed in a section or length of channel portion 1232 between fluid ejection chamber 1203 and fluid ejection chamber 1202, including, more specifically, a section or length of channel portion 1232 between fluid ejection chamber 1203 and fluid circulating element 1222. Providing narrowed portion 1235 between fluid ejection chamber 1203 and fluid ejection chamber 1202 helps to "de-couple" fluid ejection chamber 1203 from fluid ejection chamber 1202 and mitigate cross-talk between fluid ejection chamber 1203 and fluid ejection chamber 1202. In addition, providing narrowed portion 1235 between fluid circulating element 1222 and fluid ejection chamber 1203 helps to "de-couple" fluid circulating element 1222 from fluid ejection chamber 1203 and mitigate cross-talk between fluid circulating element 1222 and fluid ejection chamber 1203. Furthermore, providing narrowed portion 1235 between fluid circulating element 1222 and fluid ejection chamber 1203 helps to control a direction of pumping and prevent "blowback" toward fluid ejection chamber 1203.

Figure 13:
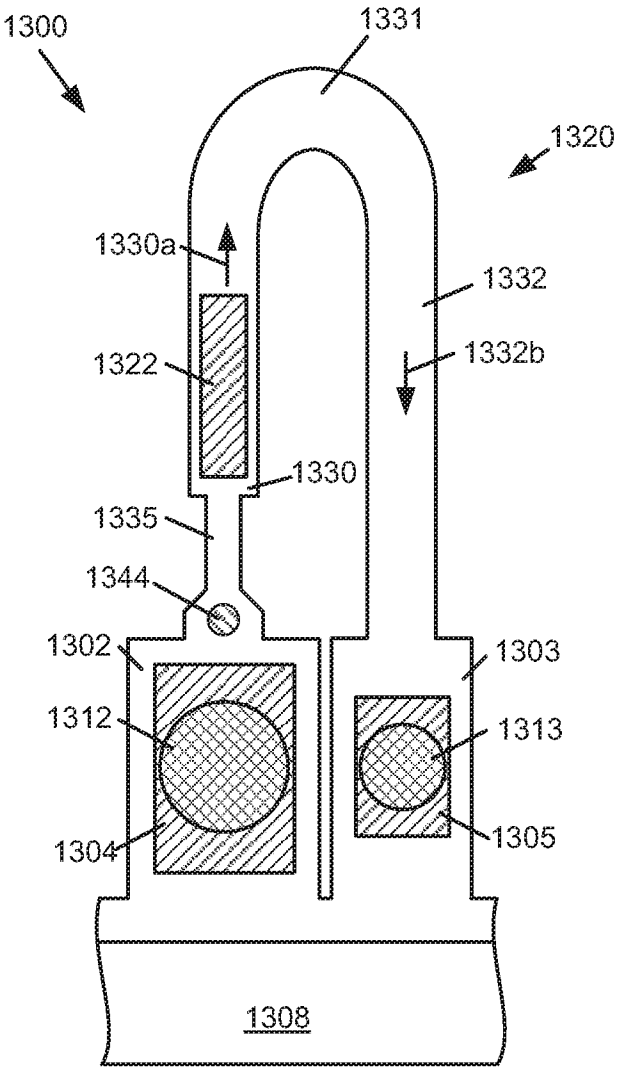
FIG. 13 is a schematic plan view illustrating an example of a portion of a fluid ejection device.

FIG. 13 is a schematic plan view illustrating an example of a portion of a fluid ejection device 1300. Similar to fluid ejection device 1100, fluid ejection device 1300 includes a first fluid ejection chamber 1302 with a corresponding drop ejecting element 1304, and a second fluid ejection chamber 1303 with a corresponding drop ejecting element 1305, such that nozzle openings or orifices 1313 and 1313 communicate with respective fluid ejection chambers 1302 and 1303. In addition, in one example, fluid ejection device 1300 includes a fluid circulation path or channel 1320 with a corresponding fluid circulating element 1322, with fluid circulation channel 1320 including a path or channel portion 1330 communicated with fluid ejection chamber 1302, and a path or channel portion 1332 communicated with fluid ejection chamber 1303. Nozzle openings or orifices 1313 and 1313 may be of a circular, non-circular, or other shape.

Similar to fluid circulation channel 1120 of fluid ejection device 1100, fluid circulation channel 1320 of fluid ejection device 1300 forms a fluid circulation (or recirculation) loop between fluid feed slot 1308, fluid ejection chamber 1302, and fluid ejection chamber 1303. For example, fluid from fluid feed slot 1308 circulates (or recirculates) through fluid ejection chamber 1302, through fluid circulation channel 1320, and through fluid ejection chamber 1303 back to fluid feed slot 1308. More specifically, fluid from fluid feed slot 1308 circulates (or recirculates) through fluid ejection chamber 1302, through channel portion 1330, through channel portion 1332, and through fluid ejection chamber 1303 back to fluid feed slot 1308.

In addition, and similar to fluid circulating element 1122 of fluid ejection device 1100, fluid circulating element 1322 is formed in, provided within, or communicated with channel portion 1330 of fluid circulation channel 1320, and forms an asymmetry to fluid circulation channel 1320 whereby a fluid flow distance between fluid circulating element 1322 and fluid ejection chamber 1302 is less than a fluid flow distance between fluid circulating element 1322 and fluid ejection chamber 1303. As such, in one example, channel portion 1330 directs fluid in a first direction, as indicated by arrow 1330*a*, and channel portion 1332 directs fluid in a second direction opposite the first direction, as indicated by arrow 1332*b*. Thus, in one example, fluid circulating element 1322 creates an average or net fluid flow in fluid circulation channel 1320 between fluid ejection chamber 1302 and fluid ejection chamber 1303. Furthermore, in one example, and similar to fluid circulation channel 1120 of fluid ejection device 1100, fluid circulation channel 1320 includes a channel loop 1331 wherein channel loop 1331 includes a U-shaped portion of fluid circulation channel 1320.

In one example, and similar to channel portion 1130 of fluid ejection device 1100, channel portion 1330 of fluid circulation channel 1320 includes a "pinch" or narrowed portion 1335 (as compared, for example, to channel portion 830 of fluid circulation channel 820). More specifically, in one example, narrowed portion 1335 is formed in a section or length of channel portion 1330 between fluid ejection chamber 1302 and fluid ejection chamber 1303, including, more specifically, a section or length of channel portion 1330 between fluid ejection chamber 1302 and fluid circulating element 1322. Providing narrowed portion 1335 between fluid ejection chamber 1302 and fluid ejection chamber 1303 helps to "de-couple" fluid ejection chamber 1302 from fluid ejection chamber 1303 and mitigate cross-talk between fluid ejection chamber 1302 and fluid ejection chamber 1303. In addition, providing narrowed portion 1335 between fluid circulating element 1322 and fluid ejection chamber 1302 helps to "de-couple" fluid circulating element 1322 from fluid ejection chamber 1302 and mitigate cross-talk between fluid circulating element 1322 and fluid ejection chamber 1302. Furthermore, providing narrowed portion 1335 between fluid circulating element 1322 and fluid ejection chamber 1302 helps to control a direction of pumping and prevent "blowback" toward fluid ejection chamber 1302.

As illustrated in the example of FIG. 13, fluid ejection device 1300 includes an object tolerant architecture 1344. Object tolerant architecture 1344 includes, for example, a pillar, a column, a post or other structure (or structures) formed or provided between fluid ejection chamber 1302 and fluid circulation channel 1320, including, more specifically, between drop ejecting element 1304 and fluid circulating element 1322. As such, object tolerant architecture 1344 is provided "upstream" or before fluid circulating element 1322 (relative to a direction of fluid flow through fluid circulation channel 1320).

In one example, object tolerant architecture 1344 forms an "island" which allows fluid to flow past and into (or from) fluid circulation channel 1320 while preventing objects, such as air bubbles or particles (e.g., dust, fibers), from flowing into (or from) fluid circulation channel 1320. For example, object tolerant architecture 1344 helps to prevent air bubbles and/or particles from entering fluid circulation channel 1320, and entering fluid ejection chamber 1303, from fluid ejection chamber 1302, and helps to prevent air bubbles and/or particles from entering fluid ejection chamber 1302 from fluid circulation channel 1320. Such objects, if allowed to enter fluid circulation channel 1320, or fluid ejection chamber 1302 or fluid ejection chamber 1303, may affect the performance of fluid ejection device 1300, including, for example, the performance of fluid circulating element 1322, or drop ejecting element 1304 or drop ejecting element 1305. In addition, object tolerant architecture 1344 helps to increase back pressure and, therefore, increase firing momentum of the ejection of drops from fluid ejection chamber 1302 by helping to contain the drive energy during drop ejection. Furthermore, object tolerant architecture 1344 helps to mitigate or minimize cross-talk between fluid ejection chamber 1302 and fluid ejection chamber 1303, and between fluid circulating element 1322 and fluid ejection chamber 1302.

Figure 14:
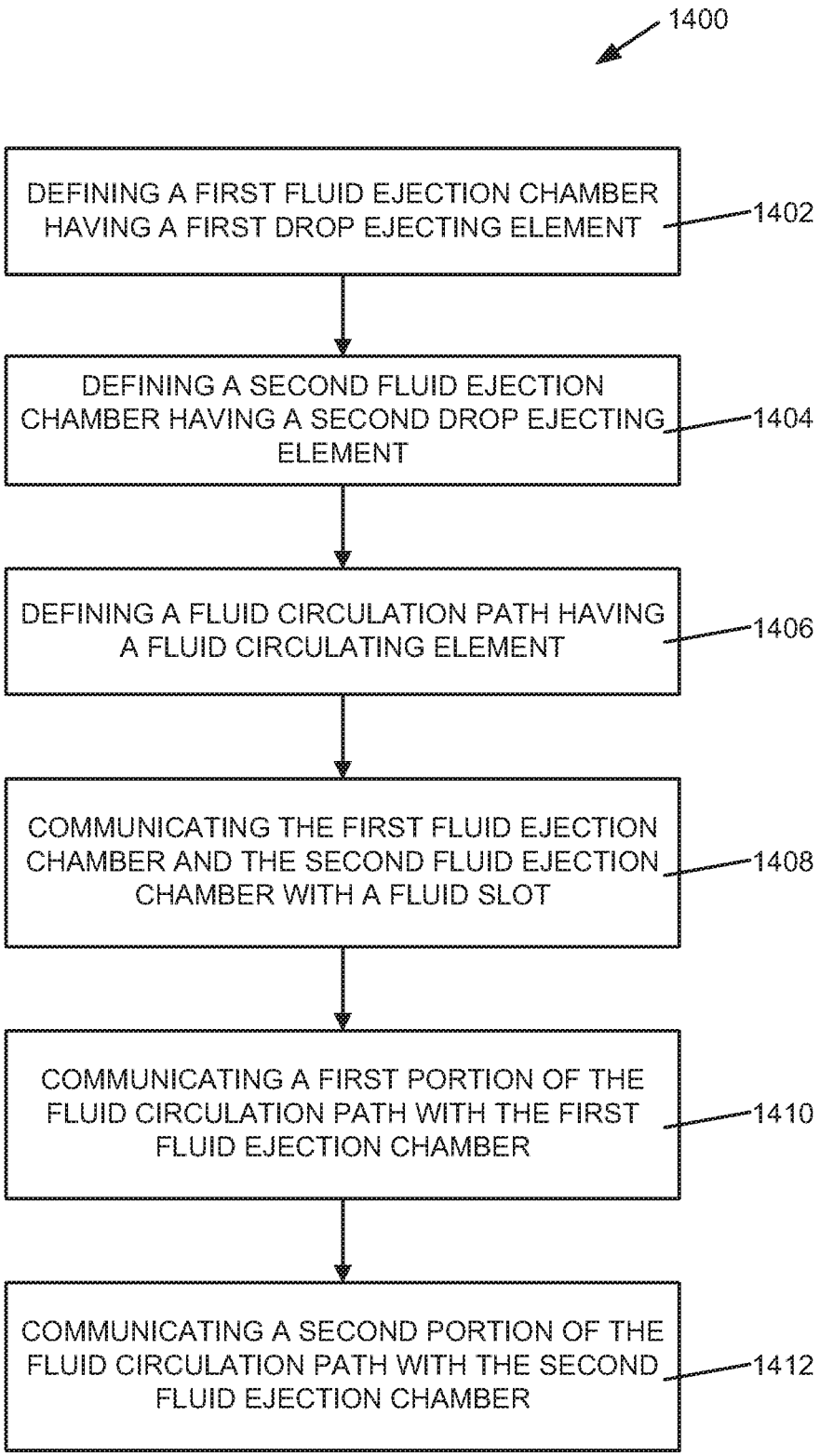
FIG. 14 is a flow diagram illustrating an example of a method of forming a fluid ejection device.

FIG. 14 is a flow diagram illustrating an example of a method 1400 of forming a fluid ejection device, such as fluid ejection device 200, 300, 400, 500, 600, 700, 800, 900, 1000, 1100, 1200, 1300 as illustrated in the respective examples of FIGS. 2, 3, 4, 5, 6, 7, 8, 9, 10, 11, 12, 13.

At 1402, method 1400 includes defining a first fluid ejection chamber having a first drop ejecting element, such as fluid ejection chambers 202, 302, 402, 502, 602, 702, 802, 902, 1002, 1102, 1202, 1302 having respective drop ejecting elements 204, 304, 404, 504, 604, 704, 804, 904, 1004, 1104, 1204, 1304.

At 1404, method 1400 includes defining a second fluid ejection chamber having a second drop ejecting element, such as fluid ejection chambers 203, 303, 403, 503, 603, 703, 803, 903, 1003, 1103, 1203, 1303 having respective drop ejecting elements 205, 305, 405, 505, 605, 705, 805, 905, 1005, 1105, 1205, 1305.

At 1406, method 1400 includes defining a fluid circulation path having a fluid circulating element, such as fluid circulation paths or channels 220, 320, 420, 520, 620, 720, 820, 920, 1020, 1120, 1220, 1320 having fluid circulating elements 222, 322, 422, 522, 622, 722, 822, 922, 1022, 1122, 1222, 1322.

At 1408, method 1400 includes communicating the first fluid ejection chamber and the second fluid ejection chamber with a fluid slot, such as fluid ejection chambers 202/203, 302/303, 402/403, 502/503, 602/603, 702/703, 802/803, 902/903, 1002/1003, 1102/1103, 1202/1203, 1302/1303 with respective fluid feed slots 208, 308, 408, 508, 608, 708, 808, 908, 1008, 1108, 1208, 1308.

At 1410, method 1400 includes communicating a first portion of the fluid circulation path with the first fluid ejection chamber, such as path or channel portions 230, 330, 430, 530, 630, 730, 830, 930, 1030, 1130, 1230, 1330 with respective fluid ejection chambers 202, 302, 402, 502, 602, 702, 802, 902, 1002, 1102, 1202, 1302.

At 1412, method 1400 includes communicating a second portion of the fluid circulation path with the second fluid ejection chamber, such as path or channel portions 232, 332, 432, 532, 632, 732, 832, 932, 1032, 1132, 1232, 1332 with respective fluid ejection chambers 203, 303, 403, 503, 603, 703, 803, 903, 1003, 1103, 1203, 1303.

Although illustrated and described as separate and/or sequential steps, the method of forming the fluid ejection device may include a different order or sequence of steps, and may combine one or more steps or perform one or more steps concurrently, partially or wholly.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

What is claimed is:

1. A fluid ejection device comprising:

a fluid slot comprising fluid;

a dual fluid ejecting mechanism operatively connected to the fluid slot and comprising different orifices to independently eject drops of the fluid, wherein the dual fluid ejecting mechanism is to combine the drops of fluid into a combined drop of fluid; and a controller to control operation of the dual fluid ejecting mechanism to eject the plurality of drops of fluid in sizes that are independently determined.

2. The fluid ejection device of claim 1, wherein the dual fluid ejecting mechanism comprises:

a first fluid ejection chamber comprising a first drop ejecting element and a first orifice; and a second fluid ejection chamber comprising a second drop ejecting element and a second orifice, wherein the drops of fluid are independently ejected from the first orifice and the second orifice.

3. The fluid ejection device of claim 1, wherein the orifices are a same size as one another.

4. The fluid ejection device of claim 3, wherein the dual fluid ejecting mechanism is to combine the drops of fluid from the orifices of the same size into the combined drop of fluid.

5. The fluid ejection device of claim 1, wherein the orifices are of different sizes.

6. The fluid ejection device of claim 5, wherein the orifices of different sizes cause the drops of fluid to be ejected in different sizes.

7. A fluid ejection device comprising:

a fluid slot comprising fluid;

a plurality of fluid ejection chambers operatively connected to the fluid slot and each comprising an orifice to eject a drop of the fluid, wherein each drop of fluid comprises a predetermined weight;

a fluid circulation path to circulate the fluid between the plurality of fluid ejection chambers; and a fluid circulating element within the fluid circulation path.

8. The fluid ejection device of claim 7, wherein orifices of the plurality of fluid ejection chambers comprise different sizes, and wherein the predetermined weight of the drop of fluid is dependent on a size of the orifice.

9. The fluid ejection device of claim 7, wherein the fluid circulating element is to circulate the fluid from a first orifice of the plurality of fluid ejection chambers to a second orifice of the plurality of fluid ejection chambers.

10. The fluid ejection device of claim 9, wherein the first orifice is of a different size than the second orifice.

11. The fluid ejection device of claim 9, wherein a position of the first orifice is offset with respect to the fluid slot.

12. A fluid ejection device comprising:

a first drop ejecting element to eject a first drop of fluid having a first weight;

a second drop ejecting element to eject a second drop of fluid having a second weight; and a controller to independently operate the first drop ejecting element and the second drop ejecting element.

13. The fluid ejection device of claim 12, wherein the first weight and the second weight are the same.

14. The fluid ejection device of claim 12, wherein the first weight and the second weight are different.

15. The fluid ejection device of claim 12, wherein the controller operates the first drop ejecting element and the second drop ejecting element at different moments of time, respectively, to eject the first drop of fluid and the second drop of fluid at the different moments of time.

16. The fluid ejection device of claim 12, wherein the controller operates the first drop ejecting element and the second drop ejecting element simultaneously to eject the first drop of fluid and the second drop of fluid simultaneously.

17. The fluid ejection device of claim 12, wherein the controller operates either the first drop ejecting element or the second drop ejecting element to drop either the first drop of fluid or the second drop of fluid.

18. The fluid ejection device of claim 12, wherein:

the first drop ejecting element comprises a first nozzle through which the first drop of fluid is ejected; and the second drop ejecting element comprises a second nozzle through which the second drop of fluid is ejected.

19. The fluid ejection device of claim 18, wherein the first nozzle and the second nozzle are a different size from one another.

20. The fluid ejection device of claim 18, wherein the first nozzle and the second nozzle are a same size as one another.

* * * * *